United States Patent [19]

Goodwin

[11] 4,058,870

[45] Nov. 22, 1977

[54] LANCE TIP CONSTRUCTION

[75] Inventor: Robert J. Goodwin, Hendersonville, N.C.

[73] Assignee: C. H. Heist Corporation, Clearwater, Fla.

[21] Appl. No.: 704,113

[22] Filed: July 9, 1976

[51] Int. Cl.[2] ..... B08B 9/02

[52] U.S. Cl. ..... 15/104.1 R

[58] Field of Search ..... 15/104.09, 104.1 R, 15/104.11, 104.14; 29/81 J; 134/8

[56] References Cited

U.S. PATENT DOCUMENTS

| | | | |
|---|---|---|---|
| 1,161,122 | 11/1915 | Froussard | 15/104.1 R |
| 1,193,361 | 8/1916 | Crepeau | 15/104.09 |
| 2,313,042 | 3/1943 | Bay | 15/104.1 R |
| 2,411,209 | 11/1946 | Hall et al. | 15/104.09 |

FOREIGN PATENT DOCUMENTS

| | | | |
|---|---|---|---|
| 286,987 | 3/1928 | United Kingdom | 15/104.1 R |

*Primary Examiner*—Edward L. Roberts
*Attorney, Agent, or Firm*—Joseph P. Gastel

[57] ABSTRACT

A tube cleaning lance tip construction for rotation within a tube comprising a body portion, a bore arrangement in the body portion for causing liquid to be ejected with a lateral component creating a reactive force for biasing the body portion toward the inside of the tube, a blade on the opposite side of the body portion from the bore arrangement for removing incrustations from the inside of the tube, the bore arrangement being positioned relative to the longitudinal axis of the body portion to cause the reactive force to be in the direction of rotation of the body portion, and stabilizing blades on the body portion for limiting layover of the blade and for tending to maintain the axis of the lance tip parallel to the axis of the tube and for aiding in the removal of incrustations.

30 Claims, 15 Drawing Figures

Fig. 10.
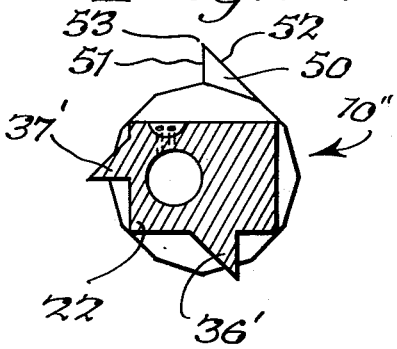
Fig. 9.
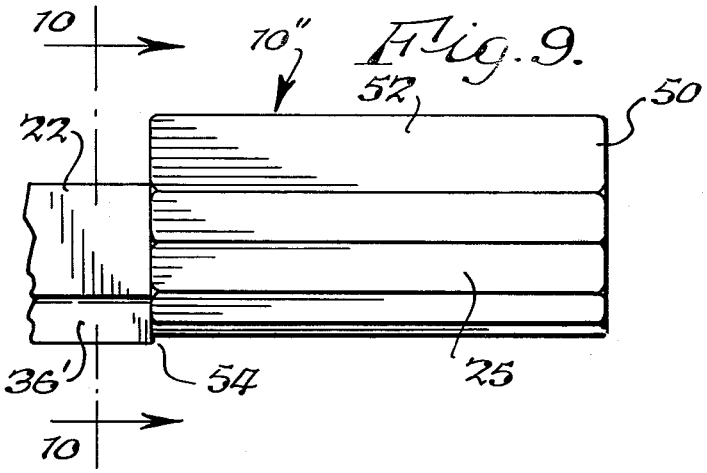
Fig. 11.
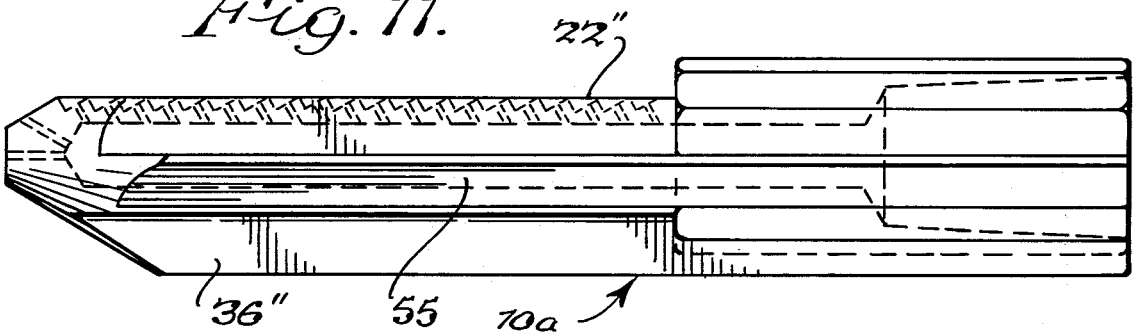
Fig. 12.
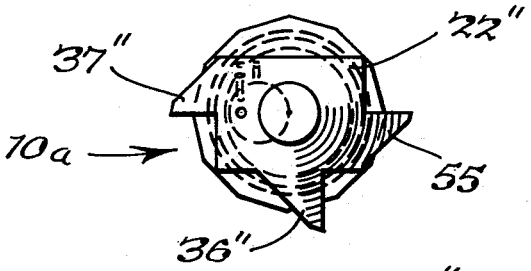
Fig. 13.
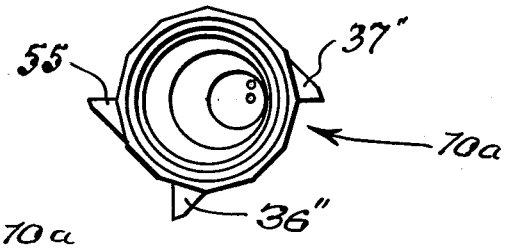
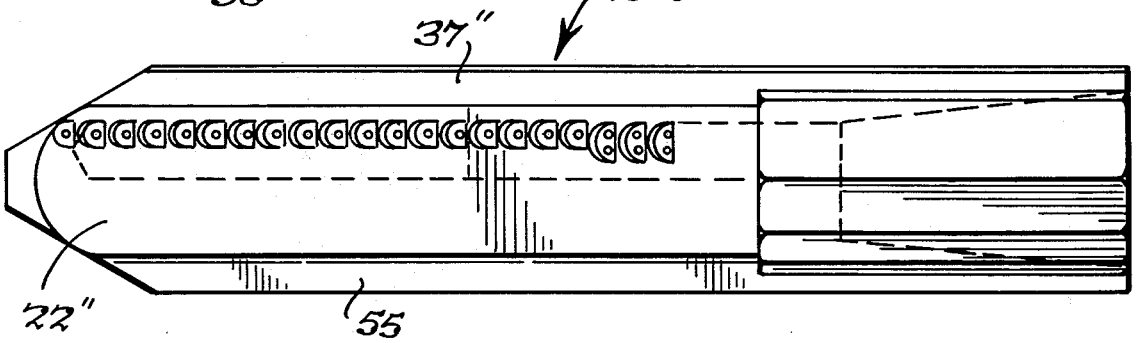
Fig. 14.

LANCE TIP CONSTRUCTION

The present invention relates to an improved lance tip construction for use in cleaning incrustations from the insides of tubes, such as those used in heat exchangers, process equipment and pipes of various sorts.

The present invention is a modification of the lance tip construction disclosed in copending U.S. application of Robert J. Goodwin, Ser. No. 611,072, filed Sept. 8, 1975 now U.S. Pat. No. 4,011,625.

By way of background, in many applications the tubes of heat exchangers, process equipment and various pipes build up foreign deposits or incrustations during normal use. These deposits may comprise compounds which include carbon, silicon and calcium as constituents and/or organic compounds depending on the nature of the fluid flowing through the tubes. In the past, the removal of such deposits was difficult, relatively inefficient and costly. Various methods which were utilized to remove the deposits included high pressure water cleaning, drilling and sandblasting. However, the high pressure water cleaning heretofore used could not remove the more tenacious deposits. The drilling and sandblasting, in addition to being slow and extremely costly processes, many times injured the inside surfaces of the tubes. In addition, other lance tips used in the past did not have the combination of required blade configuration and capacity for lateral thrust to force blades on the tips into good incrustation-removing engagement with the inside of the tubes. Such prior art lance tips are shown in U.S. Pat. Nos. 647,132, 1,193,361, 1,355,726, 2,313,042, 2,411,209 and 3,226,258.

The present invention also relates to a tube cleaning lance tip construction comprising a body portion, bore means in said body portion for causing liquid to be ejected with a lateral component creating a reactive force for biasing said body portion toward said tube, blade means on the opposite side of said body portion from said bore means for removing incrustations from the inside of said tube, and stabilizing means extending laterally outwardly from said body portion.

The various aspects of the present invention will be more fully understood when the following portions of the specification are read in conjunction with the accompanying drawings wherein:

FIG. 1*a* is a fragmentary side elevational view partially broken away showing the improved lance tip of the present invention mounted on a lance within a tube which is being cleaned;

FIG. 1*b* is a fragmentary side elevational view which is a continuation of FIG. 1*a* and shows the hydromechanical system which advances the lance axially and rotates it while supplying high pressure liquid thereto;

FIG. 9 is a fragmentary side elevational view of the coupling end of a still further modified form of lance tip showing a stabilizing blade on the same side as the jet-producing bores;

FIG. 10 is a cross sectional view taken substantially along line 10—10 of FIG. 9;

FIG. 11 is a side elevational view of a lance tip which is a further modification of the lance tip of FIGS. 2–7;

FIG. 12 is an end elevational view taken substantially from the left of FIG. 11;

FIG. 13 is an end elevational view taken substantially from the right of FIG. 11; and FIG. 14 is a plan view of the lance tip shown in FIG. 11.

Figures 1A, 1B, 2, 3, 4:
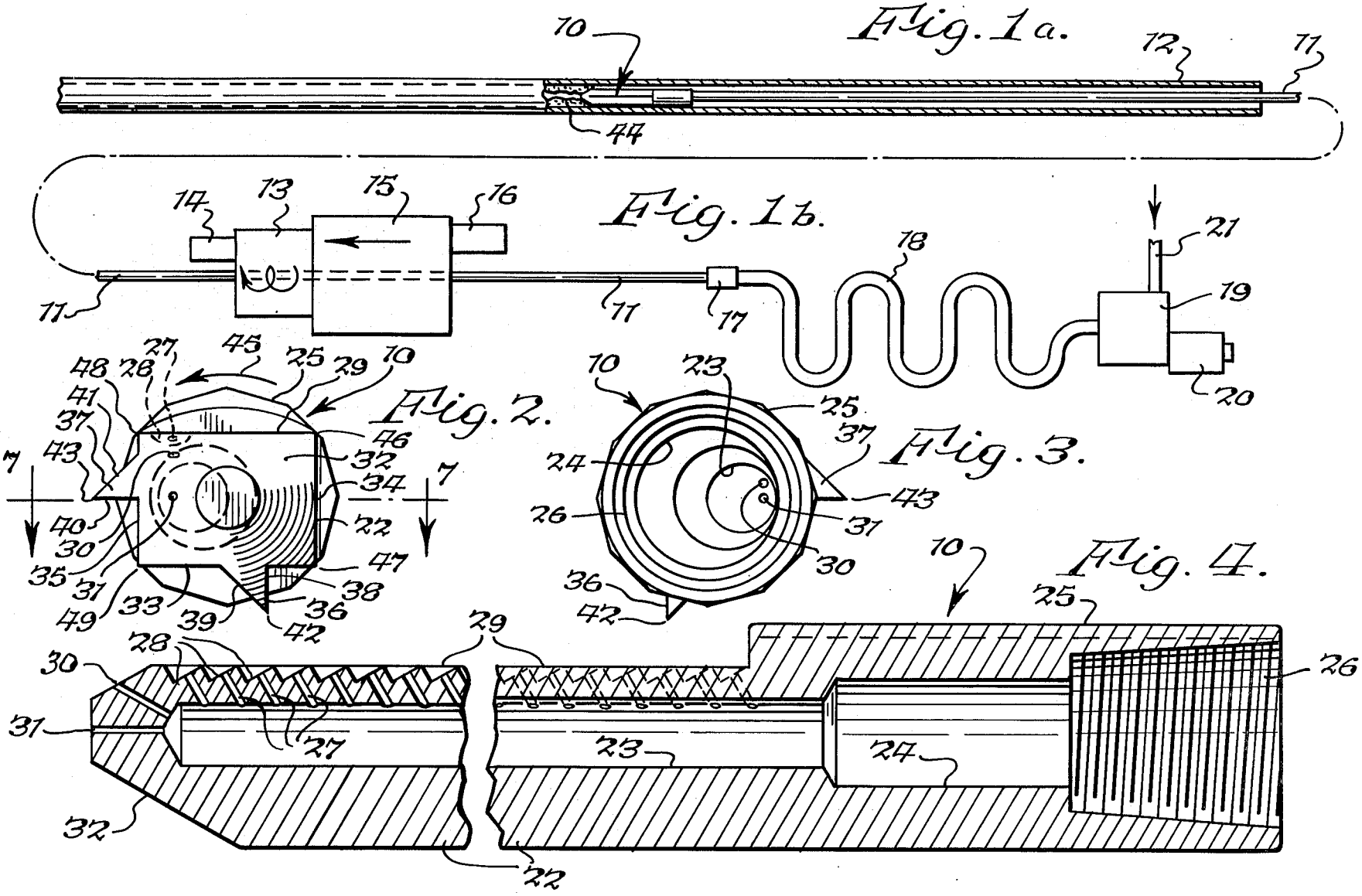
FIG. 2 is an end elevational view of the improved lance tip taken from the left of FIG. 5.
FIG. 3 is an end elevational view of the improved lance tip taken from the right of FIG. 5.
FIG. 4 is a fragmentary cross sectional view taken substantially along line 4—4 of FIG. 6 and showing particularly the angle of the bores through which the high pressure liquid is ejected, the counterbore, and the offcenter position of the main bore.

Summarizing in advance, the improved lance tip 10 of the present invention is intended to be mounted on a lance 11 which is rotated and moved axially through a tube 12 by means of a rotating mechanism 13 driven by a motor 14 and an advancing mechanism 15 driven by a motor 16. The end of lance 11 remote from lance tip 10 mounts a swivel unit 17 which is connected to hose 18. Swivel 17 prevents leakage between lance 11 and hose 18 while permitting lance 11 to rotate without any accompanying rotation of hose 18. Hose 18 is connected to pump 19 which is driven by motor 20. Pump 19 receives water from conduit 21 and supplies it at high pressure to conduit 18. Lance 11 is a hollow metal tube which is slightly greater in length than tube 12 which is to be cleaned. A common length for lance 11 is 20 to 40 feet.

The form of improved lance tip 10 which is shown in FIGS. 2–7 includes a body portion 22 having a main bore 23 which is in communication with counterbore 24 which in turn is in communication with the tapped portion 26 at the coupling end 25 of the lance tip which is threaded onto the end of lance 11. Counterbore 24 serves the purpose of reducing the fluid friction within the lance tip relative to the fluid friction that would be experienced if the counterbore were not present. In this respect, it is desirable to make counterbore 24 as large as possible.

High pressure liquid which is supplied to bore 23 is forced through jet-producing bores 27 which are in communication with main bore 23 and terminate at planar surfaces 28 formed on the planar top surface 29 of body portion 22. In addition, jet-producing bores 30 and 31 are provided which are inclined more forwardly than jet-producing bores 27 to aid in the removal of plugs or other incrustations which would interfere with passage of the lance tip 10 through tube 12. Bores 30 and 31 are located in the frustoconical nose or front portion 32 of the lance tip. The surface shown at 28 are inclined at an angle of 30 degrees to the horizontal and bores 27, being perpendicular thereto, are inclined at an angle of 60° to the horizontal. Bores 27 may be oriented at any other angle which will provide optimum cleaning and satisfactory operability. The exact angle may be tailored in accordance with the nature of the incrustations being removed. Surfaces 28 may be formed at any desired angle or may be curved, if desired.

The forward part of body portion 22 is essentially rectangular in cross sectional configuration and includes a bottom side 33 in opposition to the above-mentioned planar side or surface 29, and planar sides 34 and 35. A primary blade 36 extends outwardly from side 33 and a combined stabilizing and secondary cutting blade 37 extends outwardly from side 35. Blade 36 includes a planar leading edge 38 and a planar trailing edge 39. Blade 37 includes a planar leading edge 40 and a planar trailing edge 41. Planar edges 38 and 39 intersect to provide a sharpened cutting edge 42, and planar edges 40 and 41 intersect to provide a sharp cutting edge 43.

Figure 5:
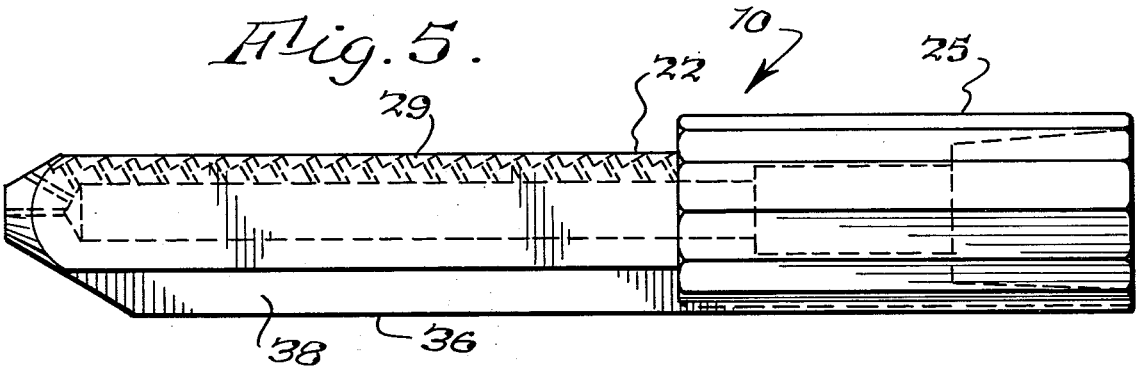
FIG. 5 is a side elevational view of the improved lance tip of the present invention.

From FIGS. 2 and 5 it can be seen that blade 36 extends outwardly from the opposite side of body portion 22 from jet-producing bores 27. Therefore, the reactive force produced by the high pressure water emanating from bores 27 causes cutting edge 42 to engage the incrustations on the inside of the tube 12 with a relatively high force. Also body portion 22 is unbalanced about its axis of rotation in the direction of blade 36. Thus, the centrifugal force of body portion 22 during rotation will force blade 36 toward the inside of the tube. As lance tip 10 rotates in tube 12, which may be located in a tube bundle, or which may be any other tube which is being cleaned, cutting edge 42 will be forced against the incrustations 44 within tube 12 for the purpose of removing them. Considering that the foregoing forces are concentrated along knife edge 42, there will be a high unit force at the knife edge 42 which will provide an extremely efficient cleaning and finishing action. It is to be especially noted that the action of the high pressure water also removes incrustations directly.

Figure 6:
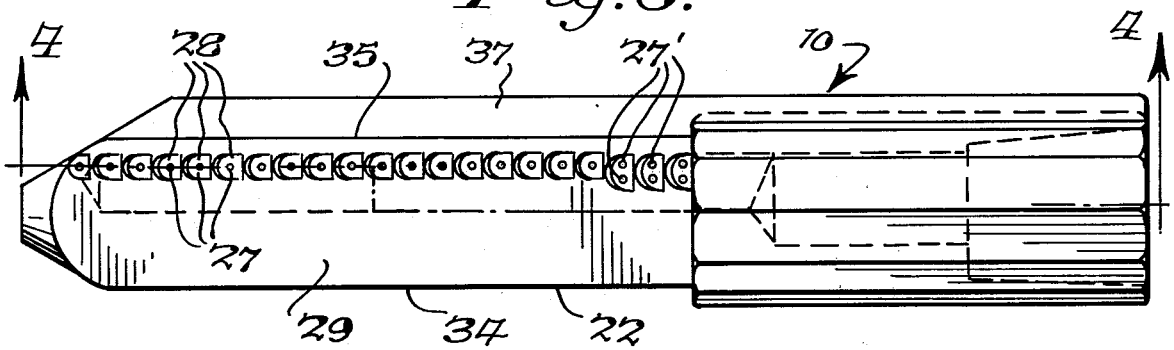
FIG. 6 is a plan view of the improved lance tip of the present invention.
Figure 7:
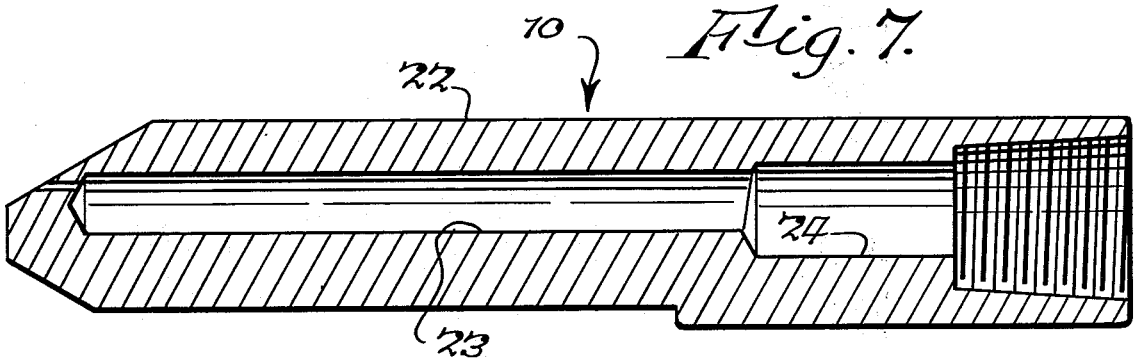
FIG. 7 is a cross sectional view taken substantially along line 7—7 of FIG. 2 and showing particularly the offcenter location of the main bore.

In accordance with the present invention, jet-producing bores 27 are offset relative to the longitudinal axis of body portion 22, as shown in FIGS. 2 and 6, for causing the reactive force created by the ejection of liquid from bores 27 to be in the direction of rotation 45 of body portion 22. This aids in forcing blade 36 into a cutting and prying engagement with the incrustations within tube 12. Stabilizing blade 37 serves to prevent lance tip 10 from laying over excessively during rotation, to thereby prevent blade 36 from assuming an undesirable cutting edge. In this respect, if the forces on body portion 22 are such that it tends to lay over excessively, secondary stabilizing and cutting blade 37 will engage the matter on the inside of tube 12. While member 37 has been disclosed as a combined stabilizing and cutting blade, it will be appreciated that it need not necessarily assume the configuration of a blade, but may be of any suitable protuberance or series of protuberances from the body portion which will serve the stabilizing function. However, it is preferable that it be in the form of a blade to provide the supplementary cutting function.

During operation the lance tip 10 and the incrustations on the inside of the tube 12 are subjected to a complex force system. The forces include the forces resulting from the rotational and axial movement of the lance tip. In addition, there are chattering types of forces resulting from the engagement of the tip with the incrustations. There are also the impacting forces resulting from the lance tip bouncing within the confines of the tube. In addition, there are the reaction forces produced by the high pressure water leaving the jet-producing bores, and the forces resulting from the rotational unbalance of the tip with respect to its longitudinal axis. Furthermore, there are the forces resulting from the high pressure water rebounding from the inside surfaces of the tube and the incrustations therein. It will therefore be appreciated that the lance tip 10 does not rotate smoothly within the tube 12 but is subjected to a complex combined rotational and bouncing action. This is especially the case when it is considered that the internal diameter of tube 12 is preferably between one to two times the diameter of lance tip 10. In view of the foregoing bouncing action, it will be appreciated that longitudinal corner edges 46, 47, 48 and 49 may intermittently engage the incrustations to produce impacting forces tending to jar the incrustations loose, and these impacting forces aid in the overall process of removal of the incrustations.

As noted briefly above, the liquid emanating from the jet-producing bores 27 aids in removing the incrustations because of its high pressure. In operation, the pressure of the liquid at the point of leaving the bores may be anywhere between 3,000 psi and 15,000 psi. Bores 27 may be arranged in any desired configuration. In this respect, as can be seen from FIG. 6, the bores 27 toward the front and middle of body portion 22 are arranged in a single row. The bores 27' toward the rear of body portion 22 are arranged in a double row. There will be a greater volume of liquid emanating in the area of the double row of bores than from an equal length along the body portion containing the single row of bores which will result in a greater reactive force tending to bias the body portion containing the double row of bores toward the tube.

As noted previously, blade 37 serves a stabilizing function in addition to the function noted above of preventing excessive layover. Blade 37, which extends substantially throughout the length of body portion 22 to the very end of the coupling portion 25 thereof, also tends to prevent lateral oscillation or fishtailing of the lance tip. This tends to cause the edge 42 of blade 36 to be oriented more parallel to the longitudinal axis of the tube than it would be if blade 37 were not present.

Figure 8:
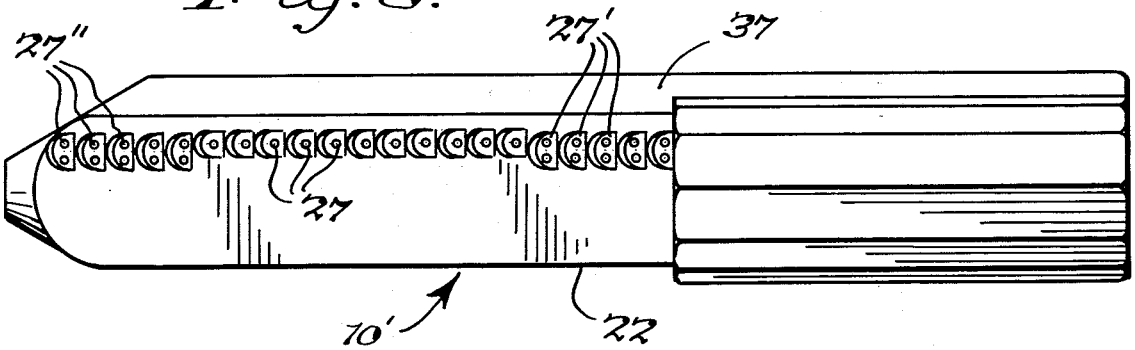
FIG. 8 is a plan view of a lance tip which is a modification of the embodiment shown in FIGS. 2–7, which includes additional bores proximate the front of the lance tip.

In FIG. 8 a modification of FIGS. 2–7 is shown. The lance tip 10' is identical in all respects to the embodiment of FIGS. 2–7 except that a double row of jet-producing bores 27'' is located at the front portion of the lance tip. Thus, this embodiment possesses a double row of jet-producing nozzles 27' toward the rear of body portion 22, a double row 27'' toward the front of the body portion, and a single row consisting of jet-producing bores 27 in the middle of body portion 22. The use of the double rows of bores at 27' and 27'' results in different volumetric flows than is obtained through the single row of bores 27 located between them. This produces augmented reactive forces in the areas where the double rows exist to assist in governing the attitude of the lance tip within the tube by applying different forces at different axial portions of the tip.

In FIGS. 9 and 10 a further modified form of lance tip 10'' is shown. Lance tip 10'' may be identical in all respects to the embodiment shown in FIGS. 2–7 except that it includes a stabilizing blade 50 on the rear coupling portion 25 of the lance tip. Blade 50 includes a planar portion 51 which intersects with planar portion 52 to provide a combined stabilizing and cutting edge 53. Blade 50 serves a stabilizing function in the sense that it limits lateral oscillation of body portion 22. In addition, it is to be noted that blades 36' and 37', which are analogous to blades 36 and 37, respectively, of FIGS. 2–7, terminate at the central portion of the lance tip. In this respect, blade 36' terminates at 54 and blade 37' terminates at a similar axial location. Blade 50 extends radially outwardly from body portion 22 a greater distance than blades 36' and 37'. Blade 50, in addition to its stabilizing function, also provides a finishing action on the inside of tube 12.

In FIGS. 11, 12, 13 and 14 a still further modified lance tip 10*a* is shown. This tip may be identical in all respects to tip 10 shown in FIGS. 2–7 except for the following differences. An additional stabilizing blade 55 is located on the opposite side of body portion 22'' from stabilizing blade 37'' which is analogous to stabilizing blade 37. In this embodiment, stabilizing blades 55 and 37'' are of greater cross sectional dimension than stabilizing blade 37. The same is true of main cutting blade 36'', which is of greater cross sectional dimension than analogous blade 36. The existence of stabilizing blade 55 on the opposite side of body portion 22' from stabilizing blade 37'' aids in eliminating lateral oscillation or fishtailing of the lance tip 10*a* as it progresses through the tube. In addition to the foregoing differences, it is to be noted that lance tip 10*a* does not possess the above mentioned counterbore 24 described above relative to FIGS. 2–7, although it will be appreciated that this counterbore may be included if desired.

In use, the lance tip 10 may be rotated between 10 and 500 rpm and advanced between 5 and 100 feet per minute.

While preferred embodiments of the present invention have been disclosed, it will be appreciated that the present invention is not limited thereto, but may be otherwise embodied within the scope of the following claims.

What is claimed is:

1. A tube cleaning lance tip construction for rotation within a tube comprising a body portion having a longitudinal axis and an outer surface, first bore means in said body portion for receiving high pressure liquid, second bore means in communication with said first bore means and extending through said body portion to said outer surface for causing liquid to be ejected with a lateral component creating a reactive force for biasing said body portion toward the inside of said tube, blade means on the opposite side of said body portion from said second bore means for removing incrustations from the inside of said tube, said second bore means being positioned relative to said longitudinal axis of said body portion for causing said reactive force to be in the direction of rotation of said body portion.

2. A tube cleaning lance tip construction as set forth in claim 1 wherein said second bore means comprises a row of bores which effects substantially uniform flow of liquid throughout its length.

3. A tube cleaning lance tip construction as set forth in claim 1 wherein said body portion includes front and rear portions and wherein said second bore means comprises front bore means proximate the front portion of said body portion and rear bore means proximate the rear portion of said body portion and wherein the flow quantity of liquid from said front bore means is different than the flow of liquid from said rear bore means.

4. A tube cleaning lance tip construction as set forth in claim 1 wherein said body portion includes front, middle, and rear portions and wherein said second bore means comprises front bore means proximate the front portion of said body portion, middle bore means proximate the middle portion of said body portion and rear bore means proximate the rear portion of said body portion and wherein the flow of liquid from said middle bore means is different from the flow from said front and rear bore means.

5. A tube cleaning lance tip construction as set forth in claim 1 wherein said body portion has a leading end and a trailing end and wherein said blade means extends substantially from said leading end of said body portion to said trailing end of said body portion.

6. A tube cleaning lance tip construction as set forth in claim 1 including stabilizing means extending outwardly of said body portion.

7. A tube cleaning lane tip construction as set forth in claim 6 wherein said body portion has a leading end and a trailing end and wherein said blade means and said stabilizing means extend substantially from said leading end of said body portion to said trailing end of said body portion.

8. A tube cleaning lance tip construction as set forth in claim 1 including stabilizing means located on the side of said body portion upon which said second bore means are located for limiting the lateral movement of the lance tip.

9. A tube cleaning lance tip construction as set forth in claim 8 wherein said body portion has a front end and a rear end and wherein said stabilizing means is located proximate said rear end of said body portion.

10. A tube cleaning lance tip construction as set forth in claim 8 wherein said stabilizing means comprises second blade means.

11. A tube cleaning lance tip construction as set forth in claim 1 including stabilizing means extending longitudinally of said body portion on the side of said body portion intermediate said second bore means and said blade means, said stabilizing means being located on the side of said body portion which follows said blade means and precedes said second bore means during rotation of said body portion to thereby limit layover of said blade means.

12. A tube cleaning lance tip construction as set forth in claim 11 wherein said stabilizing means comprises second blade means.

13. A tube cleaning lance tip construction as set forth in claim 11 including second stabilizing means on the side of said body portion opposite said stabilizing means for lessening lateral oscillation of said body portion during rotation thereof.

14. A tube cleaning lance tip construction as set forth in claim 13 wherein said second stabilizing means comprises second blade means.

15. A tube cleaning lance tip construction as set forth in claim 13 wherein said body portion has a leading end and a trailing end and wherein said blade means, said stabilizing means and said second stabilizing means extend substantially from said leading end of said body portion to said trailing end of said body portion.

16. A tube cleaning lance tip construction as set forth in claim 13 including coupling means on said body portion for attachment to a lance and wherein said stabilizing means and said second stabilizing means comprise second and third blade means, respectively, and wherein said body portion has a leading end and a trailing end and wherein said blade means, said stabilizing means and said second stabilizing means extend substantially from said leading end of said body portion to said trailing end of said body portion, and wherein said first bore means comprises a first bore extending longitudinally of said body portion, and wherein said body portion includes front and rear portions and wherein said second bore means comprises front bore means proximate said front portion of said body portion and rear bore means proximate said rear portion of said body portion and wherein the flow of liquid from said front bore means is different from the flow of liquid from said rear bore means.

17. A tube cleaning lance tip construction as set forth in claim 11 wherein said body portion includes a front end and a rear end, and second stabilizing means located on the side of said body portion upon which said second bore means are located for limiting the lateral movement of the front end of the lance tip.

18. A tube cleaning lance tip construction as set forth in claim 17 wherein said second stabilizing means is located proximate said rear end of said body portion.

19. A tube cleaning lance tip construction as set forth in claim 18 wherein said second stabilizing means comprises second blade means.

20. A tube cleaning lance tip construction as set forth in claim 17 including coupling means at the rear end of said body portion for attachment to a lance, and wherein said first bore means comprises a first bore extending longitudinally of said body portion and counterbore means proximate said coupling means and in communication with said first bore for limiting friction of liquid flowing through said lance tip, and wherein said second bore means comprises a plurality of second bores extending between said first bore and the outer surface of said body portion.

21. A tube cleaning lance tip construction as set forth in claim 20 wherein said body portion includes front, middle, and rear portions and wherein said second bore means comprises front bore means proximate the front portion of said body portion, middle bore means proximate the middle portion of said body portion and rear bore means proximate the rear portion of said body portion, and wherein the flow of liquid from said middle bore means is different from the flow from said front and rear bore means and wherein said stabilizing means and said second stabilizing means comprises first and second blade means and wherein said second stabilizing means is located proximate said rear portion of said body portion.

22. A tube cleaning lance tip construction as set forth in claim 1 including coupling means on said body portion for attachment to a lance, and wherein said first bore means comprises a first bore extending longitudinally of said body portion and counterbore means proximate said coupling means and in communication with said first bore for limiting friction of liquid flowing through said lance tip, and wherein said second bore means comprises a plurality of second bores extending between said first bore and said outer surface of said body portion.

23. A tube cleaning lance tip construction as set forth in claim 22 including stabilizing means located on the side of said body portion upon which said second bores are located.

24. A tube cleaning lance tip construction as set forth in claim 22 including stabilizing blade means extending longitudinally of said body portion on the side of said body portion intermediate said second bore means and said blade means, said stabilizing blade means being located on the side of said body portion which follows said blade means and precedes said second bore means during rotation of said body portion to thereby limit layover of said blade means.

25. A tube cleaning lance tip construction as set forth in claim 23 wherein said body portion includes a leading end and a trailing end and wherein said blade means and said stabilizing means extend substantially from said leading end of said body portion to said trailing end of said body portion and wherein said body portion includes front, middle, and rear portions and wherein said second bores comprise front bore means proximate said front portion of said body portion and middle bore means proximate said middle portion of said body portion and rear bore means proximate said rear portion of said body portion and wherein the flow of liquid from said middle bore means is different from the flow from said front and rear bore means.

26. A tube cleaning lance tip construction comprising a body portion having a longitudinal axis and an outer surface, first bore means in said body portion for receiving high pressure liquid, second bore means in communication with said first bore means and extending through said body portion to said outer surface for causing liquid to be ejected with a lateral component creating a reactive force for biasing said body portion toward said tube, blade means on the opposite side of said body portion from said second bore means for removing incrustations from the inside of said tube, stabilizing means extending laterally outwardly from said body portion, said stabilizing means extending longitudinally of said body portion on the side of said body portion intermediate said second bore means and said blade means, said stabilizng means being located on the side of said body portion which follows said blade means and precedes said second bore means during rotation of said body portion, and second stabilizing means on the opposite side of said body portion from said first stabilizing means.

27. A tube cleaning lance tip construction as set forth in claim 26 wherein said stabilizing means and said second stabilizing means comprise second and third blade means, respectively.

28. A tube cleaning lance tip construction comprising a body portion having a longitudinal axis and an outer surface, first bore means in said body portion for receiving high pressure liquid, second bore means in communication with said first bore means and extending through said body portion to said outer surface for causing liquid to be ejected with a lateral component creating a reactive force for biasing said body portion toward said tube, blade means on the opposite side of said body portion from said second bore means for removing incrustations from the inside of said tube, stabilizing means extending laterally outwardly from said body portion, said stabilizing means extending longitudinally of said body portion on the side of said body portion intermediate said second bore means and said blade means, said stabilizing means being located on the side of said body portion which follows said blade means and precedes said second bore means during rotation of said body portion, and second stabilizing means on the opposite side of said body portion from said blade means.

29. A tube cleaning lance tip construction as set forth in claim 28 wherein said stabilizing means and said second stabilizing means comprises second and third blade means, respectively.

30. A tube cleaning lance tip construction comprising a body portion having a longitudinal axis and an outer surface, first bore means in said body portion for receiving high pressure liquid, second bore means in communication with said first bore means and extending through said body portion to said outer surface for causing liquid to be ejected with a lateral component creating a reactive force for biasing said body portion toward said tube, blade means on the opposite side of said body portion from said second bore means for removing incrustations from the inside of said tube, stabilizing means extending laterally outwardly from said body portion, coupling means on said body portion for attachment to a lance, said first bore means comprising a first bore extending longitudinally of said body portion and counterbore means proximate said coupling means and in communication with said first bore for limiting friction of liquid flowing through said lance tip, and said second bore means comprising a plurality of second bores extending between said first bore and the outer surface of said body portion.

* * * * *

UNITED STATES PATENT OFFICE
CERTIFICATE OF CORRECTION

PATENT NO. : 4,058,870

DATED : November 22, 1977

INVENTOR(S) : Robert J. Goodwin

It is certified that error appears in the above-identified patent and that said Letters Patent are hereby corrected as shown below:

Column 1, after line 33, insert the following paragraph:

--The present invention relates to a tube cleaning lance tip construction for rotation within a tube comprising a body portion, bore means in said body portion for causing liquid to be ejected with a lateral component creating a reactive force for biasing said body portion toward the inside of said tube, blade means on the opposite side of said body portion from said bore means for removing incrustations from the inside of said tube, said bore means being positioned relative to the longitudinal axis of said body portion for causing said reactive force to be in the direction of rotation of said body portion.--

Column 2, line 60, change "surface" to --surfaces--.

Column 3, line 43, change "edge" to --angle--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*